United States Patent [19]

Gazda

[11] 4,043,392

[45] Aug. 23, 1977

[54] WELL SYSTEM

[75] Inventor: Imre I. Gazda, Saginaw, Tex.

[73] Assignee: Otis Engineering Corporation, Dallas, Tex.

[21] Appl. No.: 627,683

[22] Filed: Oct. 31, 1975

Related U.S. Application Data

[63] Continuation-in-part of Ser. No. 413,617, Nov. 7, 1973, Pat. No. 3,874,634, and Ser. No. 542,117, Jan. 20, 1975.

[51] Int. Cl.[2] ..... E21B 23/00

[52] U.S. Cl. ..... 166/217; 166/154; 251/319

[58] Field of Search ..... 166/154, 217, 224; 251/319

[56] References Cited

U.S. PATENT DOCUMENTS

| | | | |
|---|---|---|---|
| 3,606,926 | 9/1971 | Schwegman | 166/154 |
| 3,845,815 | 11/1974 | Garwood | 166/154 |
| 3,874,634 | 4/1975 | Gazda | 251/319 |
| 3,948,322 | 4/1976 | Baker | 166/154 |

*Primary Examiner*—James A. Leppink
*Attorney, Agent, or Firm*—H. Mathews Garland

[57] ABSTRACT

A well system for selectively locking well tools along a flow conductor in a well bore and a tool string for use in the flow conductor including a locking mandrel, a sleeve shifting device, and a well safety valve. The selective locking system has a landing and locking recess profile including both upwardly and downwardly facing stop shoulders. One form of the locking system is in a sliding sleeve valve including a cam release shoulder to free a selector and locking key when the sleeve valve is moved between spaced longitudinal locations. Another form of the locking system may be along a landing nipple and require that the well tool locked therein be disabled for release of the selector and locking tools. The sleeve shifting device has means for opening and closing the sliding sleeve valve including keys having upwardly and downwardly facing stop shoulders and recess profiles which are compatible with the landing and locking recess profile of the sleeve valve or of a landing nipple. The sleeve shifting device may be used also as a locking mandrel. Selectivity is provided by variation in the landing and locking profiles and the key profiles.

11 Claims, 22 Drawing Figures

500
500a
500h
500b
500c
500i
500d
400
400x
400a
400h
400b
400e
400j
400f
400c
400i
400g
400d
400A
300
300J
300a
300e
300h
300b
300f
300c
300i
300g
300d

WELL SYSTEM

This is a continuation-in-part of my U.S. Pat. application Ser. No. 413,617 filed Nov. 7, 1973, now U.S. Pat. No. 3,874,634, issued Apr. 1, 1975, and of U.S. Pat. application Ser. No. 542,117, filed Jan. 20, 1975.

This invention relates to well tools and systems and more particularly relates to a system for selectively landing and locking well tools along a flow conductor.

Well systems are well known wherein devices are provided for selectively locking well tools along a flow conductor by means of a locking key with a profile which is engageable in a sliding sleeve valve, a landing nipple, and the like have internal recesses and shoulder surfaces compatible with the key profiles. Selectivity is provided by varying the key and receiving profiles. One such system is illustrated in U.S. Pat. No. 2,862,564 entitled Anchoring Devices for Well Tools issued Dec. 2, 1958 to James H. Bostock. The presently known selective landing and locking systems utilize a single stop shoulder whereby a well tool is locked against movement in only a single direction by a locking tool.

In accordance with the invention, there is provided a selective well system for selectively landing and locking a well tool along a well flow conductor. Selective landing and locking keys mounted on a well tool have an external profile having spaced stop shoulders facing oppositely along the longitudinal axis of the keys. A compatible landing and locking recess profile having corresponding oppositely facing locking shoulders is provided in the form of a landing nipple and in a sliding sleeve valve, as needed by the well installation, to receive the keys. Selectivity is provided by varying the profile recess numbers and dimensions.

It is a principle object of the invention to provide a new and improved well system for landing and locking well tools along a flow conductor.

It is another object of the invention to provide a well system of the character described which is selective to permit landing and locking a well tool at a desired location along a flow conductor.

It is another object of the invention to provide a system of the character described which utilizes two spaced stop shoulders for locking a well tool against movement in two opposite directions.

It is another object of the invention to provide a system of the character described wherein a well tool which is lockable in a sliding sleeve valve can be landed and locked only when the sleeve valve is moved from a first position to a second position and the tool is retrievable only when the sleeve valve is moved back to the first position.

It is another object of the invention to provide a well system of the character decribed wherein a well tool is removed from a landing nipple only by a force operable to contract the locking keys inwardly as by disabling the key expanding mechanism or by activating positive key retracting means.

The foregoing objects and advantages together with specific details of the invention will be better understood from the following detailed description taken in conjunction with the accompanying drawings wherein:

FIG. 1 is a fragmentary longitudinal view in section and in elevation showing a safety valve tool string supported in a well tubing string through a sliding sleeve having landing and locking profile means in accordance with the invention;

FIGS. 2A, 2B, 2C, and 2D, taken together, constitute an enlarged longitudinal view in section and elevation of a safety valve tool string and well tubing structure as shown in FIG. 1;

Figure 1:
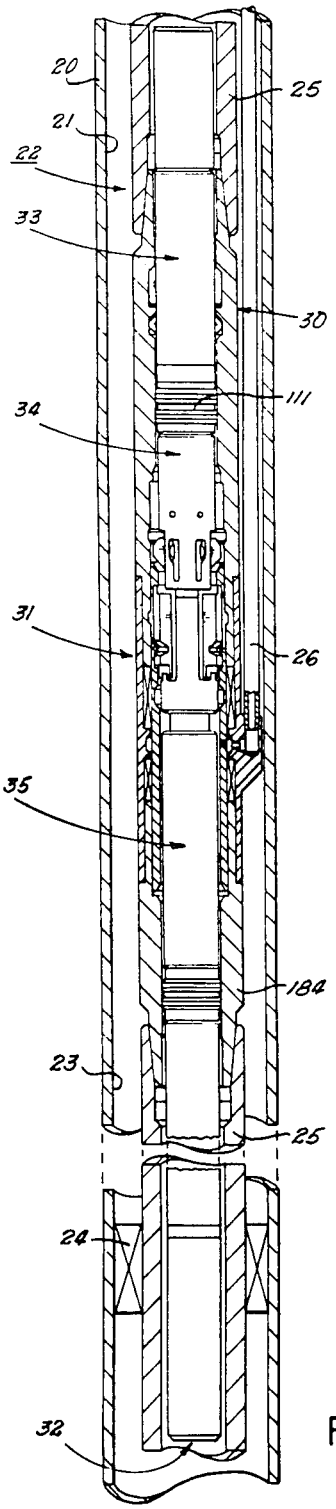

Referring to FIG. 1 a typical well installation including a landing and locking system in accordance with the invention has a well casing 20 of conventional design for lining a well bore 21 and a tubing string 22 supported in the well bore from a wellhead at the surface, not shown. The annular space 23 around the tubing string within the well bore is typically sealed by a suitable packer engaged between the casing and the tubing string above the formation to be produced through the tubing string, not shown. The tubing string includes a plurality of conventional pipe sections 25 connected together to form a conduit from the wellhead to a desired depth below the packer. At the depth in the well at which a safety valve is to be installed a landing nipple 30 and a sliding sleeve valve 31 having the features of the invention are connected together in the tubing string between adjacent ends to two pipe sections 25. The sleeve valve is connected to a control fluid line 26 leading to the surface.

In accordance with the invention a safety valve tool string 32 is releasably locked in the tubing string through the locking mandrel and sliding sleeve valve. The tool string includes a wireline controllable locking mandrel 33, a sleeve valve operating tool or shifter 34, and a remotely controllable safety valve 35. The locking mandrel 33 is a Type X Otis tool which is commercially available as illustrated and described at pages 3458 and 3459 of *The Composite Catalog of Oilfield Equipment and Services,* 1972–73 Edition, published by World Oil, Houston, Tex. The landing nipple 30, the sliding sleeve valve 31, the sleeve shifter 34, and the safety valve 35 are designed as illustrated and described herein. The sleeve valve is communicated with the surface by the control line 26 through which control fluid is directed to the safety valve for controlling the opening and closing of the valve. The sleeve shifter includes operating keys having a profile with two spaced shoulders which fit the profile of the sleeve and open and close the valve during installation and removal of the tool string. As the tool string is lowered in the tubing string to the proper depth, the sleeve valve is opened by the sleeve shifter so that when the safety valve is supported through the sleeve valve, control fluid may be directed to the safety valve to bias it open. When the tool string is retrieved from the tubing string, the sleeve shifter closes the sleeve valve. In the event that the sleeve valve cannot be closed with the normal forces used for operating the sleeve shifter, the shifter shifts to an emergency release mode in which the tool string is removable from the landing nipple and sliding sleeve valve without damaging the sleeve shifter and the sleeve valve is then operated by tools especially designed for such emergency situations.

The landing nipple 30 has reduced upper pin portion 41 threaded into the lower end of the pipe section 25 above the tubing nipple. The landing nipple is provided internally with a pair of spaced locking recesses 42 and 43 above and below a locking shoulder 44 which define a locking recess profile compatible with the locking keys on the mandrel 33 to permit the locking and release of the mandrel in the landing nipple. The landing nipple has a reduced lower end portion 45 threaded into a housing section of the sliding sleeve valve 31 forming the upper end of the sleeve valve housing, FIG. 2B. Below the landing nipple locking recesses 42 and 43 the nipple has a reduced bore portion 46 which serves as a seal surface for a seal assembly on the locking mandrel. Below the seal surface 46 the landing nipple has a downwardly diverging key operating cam surface 47 at the upper end of an annular recess 48. Below the recess 48 the landing nipple is further enlarged providing an elongated uniform bore portion 49 extending downwardly from a downwardly facing annular stop shoulder 50 through the lower end of the landing nipple housing providing a bore portion along which the valve member of the sliding sleeve operates. The bore portion 49 has longitudinally spaced upper and lower sleeve locking recesses 55 and 56, respectively, for locking the sleeve valve at an upper closed and a lower open position. The lower end portion 45 of the landing nipple is threaded into the upper end portion of a sleeve valve housing section 57. The lower end 45 of the landing nipple has an external annular recess fitted with a ring seal 58 which seals between the landing nipple and the sleeve valve housing section 57.

A longitudinally movable valve sleeve 59 is disposed in the connecting bores of the lower end portion of the landing nipple, the housing section 57 of the sleeve valve housing, and a section 60 of the sleeve valve housing. The sleeve valve 59 has a side port 60 which communicates with a side port 65 when the sleeve is at the lower open position shown in FIG. 2B. An annular seal assembly 66 is mounted around the sleeve 59 in the housing section 57 below the lower end edge 67 of the landing nipple portion 45. The seal assembly 66 is held against downward movement within the housing section 57 by an internal annular lock ring 68 engaged in an internal annular recess 69 of the housing section 57. Another seal assembly 70 is positioned within the housing section 57 between the lock ring 68 and an upwardly facing stop shoulder 75 within the housing section above the side port 65. Below the housing section side port 65 another annular seal assembly 76 is mounted between a downwardly facing internal annular stop shoulder 77 within the housing section below the side port 65 and an upper end edge 78 on an upper reduced threaded section 79 of the lower sleeve valve housing section 60. A ring seal 80 in an external annular recess of the upper end portion 79 of the lower housing section 60 seals between the lower housing section and the housing section 57 below the seal assembly 76.

Figure 2A:
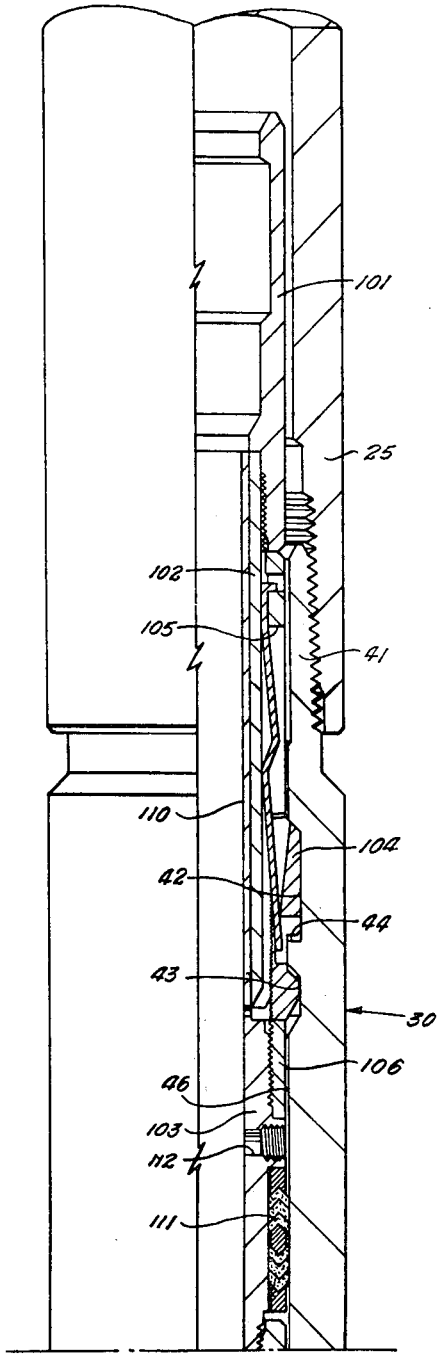
Figure 2B:
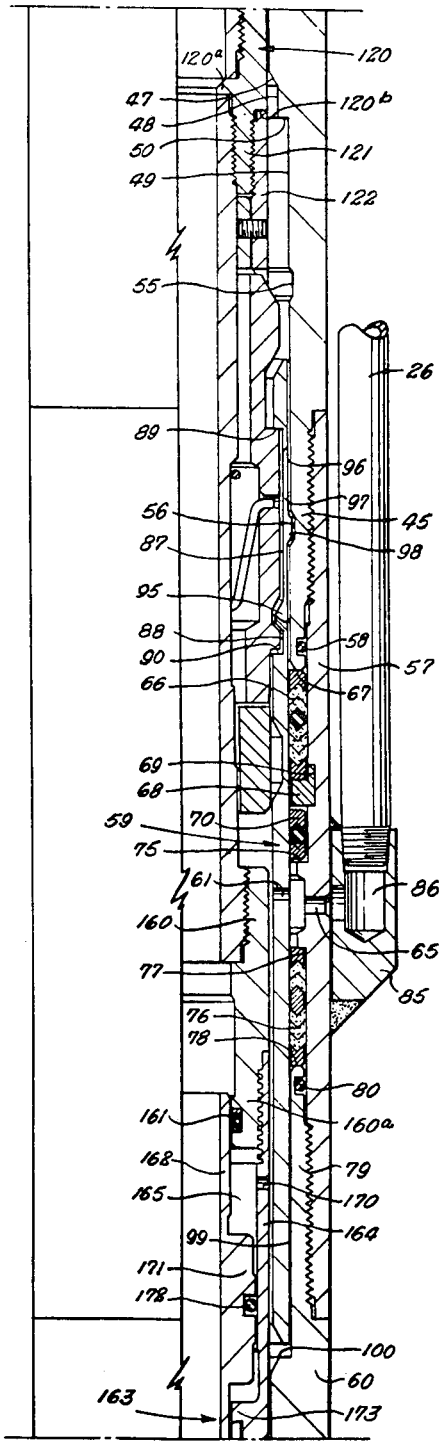

A side fitting 85 is connected along the side of the housing section 57 and provided wih an L-shaped flow passage 86 to conduct control fluid into the side port 65 from the control line 26 which is connected into the fitting as seen in FIG. 2B. The control line communicates control fluid from the surface through the passage 86 and the side ports 61 and 65 into the safety valve 35 within the sliding sleeve valve for controlling the safety valve operation.

The sleeve valve 59 has upper internal recesses 87 and 88. The upper recess 87 is an elongated recess defined below a downwardly facing stop shoulder 89 within the sleeve valve. The lower end of the lower recess 88 is defined by an upwardly facing stop shoulder 90. Between the upper and lower recesses 87 and 88 an internal tapered flange 95 is provided. The upper end portion of the sleeve valve 59 is provided with longitudinal slots 96 which extend from just below the internal shoulder 89 to approximately the center of the internal shoulder 95. The slots 96 are circumferentially spaced so that a plurality of circumferentially spaced collet fingers 97 are defined along the sleeve valve. Each of the collet fingers has an external locking boss 98. The bosses 98 on the collet fingers are engageable in either of the upper and lower locking recesses 55 and 56 along the lower end portion 45 of the landing nipple, as seen in FIG. 2B, to releasably lock the sleeve valve at an upper closed position and at a lower open position, as shown in FIG. 2B.

The upper end portion 79 of the lower sleeve valve housing section 60 has a bore portion 99 in which the lower end portion of the sleeve valve 59 slides. An internal annular upwardly facing stop shoulder 100 within the housing section 60 at the lower end of the bore portion 99 limits the downward movement of the sleeve valve 59 to the open position shown in FIG. 2B. Thus, the sleeve valve is movable between the shoulder 50 within the lower end portion 45 of the landing nipple and the shoulder 100 within the upper end portion 79 of the lower housing section 60. When the upper end edge of the sleeve valve is engaged with the shoulder 50, the valve is closed; when the lower end edge of the sleeve valve engages the shoulder 100, the valve is open. The sleeve valve housing section 60 has a reduced lower end pin portion 101 threaded into the upper end of the tubing section 25 which extends downwardly through the packer 24. Since the landing nipple 30 and the sliding sleeve valve 31 are an integral part of the tubing string 22, they are made up in the string as the string is run into the well bore.

The type X Otis locking mandrel 33 has a fishing neck 101 connected with an expander mandrel 102 supported on a body or packer mandrel 103. A plurality of circumferentially spaced radially movable locking dogs 104 are disposed in circumferentially spaced windows 105 in a sleeve 106 secured on the mandrel 103. The dogs are coupled with double acting springs 110 which bias the dogs outwardly to locating positions for properly seeking and stopping the locking mandrel at locking recesses within a locking nipple, such as the nipple 30 in a tubing string. An external seal assembly 111 is supported along the lower end portion of the mandrel 103 for sealing with the seal surface 46 in the landing nipple. The mandrel 103 has a shear screw hole 112 for connecting the mandrel with a suitable running tool, not shown, such as the Otis Type X running tool shown at page 3,459 of *The Composite Catalog of Oilfield Equipment and Services,* supra. Further details on the structure and operation of the locking mandrel and running tools are found in the reference catalog.

The lower end portion of the locking mandrel body 103 is connected into the sleeve shifter 34 which operates the sliding sleeve valve 31 and supports the safety valve 35 within the sleeve valve. The details of the sleeve shifter are principally shown in FIGS. 2B, 5, 6, and 7. The sleeve shifter has a top sub 120 which threads on the bottom end of the locking mandrel 33 as illustrated in FIGS. 2A and 2B. The top sub 120 has a reduced lower end portion 121 which is internally and externally threaded for connection wih an outer sleeve 122 and an inner enlongated body mandrel 123. The sleeve 122 threads onto the top sub 121 while the mandrel 123 threads into the sub so that the sleeve and mandrel are in concentric spaced relationship as seen at the upper portion of FIG. 2B. Fitted around the inner mandrel 123 and extending upwardly into the sleeve 122 is an inner sleeve 124 which is substantially longer than the sleeve 122 and telescopes into the sleeve 122 along an upper end portion. A pair of sleeve-shifting keys 125 are supported in operative relationship with the sleeves 122 and 124 around the mandrel for radial expansion and contraction to engage with and disengage from the sleeve valve 59 of the sliding sleeve valve 31. The outer sleeve 122 has a pair of slots 130 along opposite sides of the sleeve opening through an end of the sleeve and defining a pair of identical oppositely disposed leg portions 131. Each of the leg portions has two guide windows 132 which include a wide key expansion portion 133 and a narrow key contracting or release portion 134. The pair of guide windows adjacent to and on opposite sides of each of the sleeve slots 131 guide the end of the key 125 in that slot between expanded and contracted positions as the key is moved longitudinally. The sleeve 122 has four circumferentially spaced holes 135, each of which receives a threaded shear screw 140 for releasably securing the inner sleeve 124 with the outer sleeve 122 in the normal running relationship shown in FIG. 2B.

Figure 5:
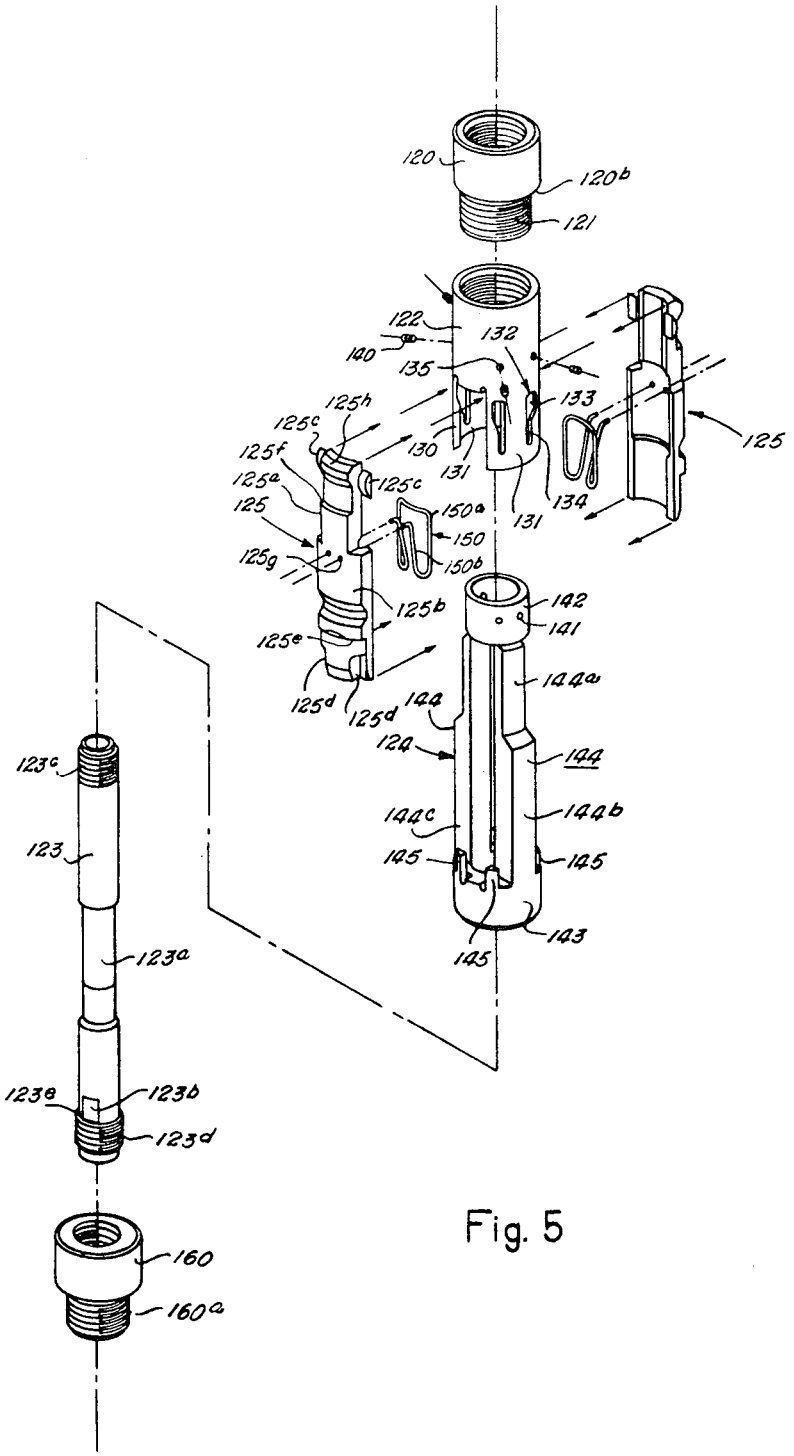
FIG. 5 is an exploded view in perspective of the sleeve shifter of the tool string.

The shear screw 140 extend through the holes 135 into corresponding holes 141 in a head ring 142 of the inner sleeve 124 supporting the inner sleeve within the outer sleeve 122 in the concentric relationship seen in FIG. 2B. The inner sleeve 124 has a base ring 143 connected with the head ring 142 by a pair of parallel longitudinal body members 144, each of which has cylindrical inner and outer surface portions to conform the member surfaces to the body mandrel 123 and the inner wall surfaces of tubing string, landing nipples, and the like. The longitudinal body members 144 have upper thin-wall portions **144*a* and lower thick-wall portions 144*b*. The effective outside diameter of the thin-wall portions 144*a* is scaled to permit the inner sleeve to telescope into the outer sleeve, as shown in FIGS. 2B and 5, with the longitudinal center lines of the side members 144 aligned with the center lines of the outer sleeve legs 131 so that the key windows 132 in each leg 131 are on opposite sides of the inner sleeve side member 144 which is aligned with and adjacent to the leg 131. The effective outside diameter of the outer sleeve side portions 144*b* is substantially equal to the outside diameter of the outer sleeve 122. The flat side surfaces 144*c* of the inner sleeve side members 144 between the rings 142 and 143 and the downwardly opening key slots 130 of the outer sleeve 122 define an inverted T-shaped side pocket down each side of the assembled inner and outer sleeves for the keys 125. The base ring 143 of the inner sleeve has a pair of upwardly extending key retainer fingers 145 circumferentially spaced and symmetrically formed on each side of the inner sleeve extending upwardly from the base ring spaced from and parallel to the flat side surfaces 144*c* of the side members of the inner sleeve. The fingers 145 serve to retain the foot or lower ends of the keys 125** in proper positions along each side of the inner sleeve permitting radial contraction and expansion of the keys while limiting the maximum expansion of the keys.

The pair of keys 125 of the sleeve shifter are adapted to engage with and release from the sleeve valve 59 of the sliding sleeve valve 31. The keys each have a narrow head portion **125*a* and a wider body portion 125*b* providing an inverted T-shape which loosely fits within each pocket defined along the opposite vertical sides of the assembled inner and outer sleeves. The key head portion 125*a* is of a width which loosely fits within the downwardly opening slot 130 on each side of the outer sleeve 122. A pair of sidewardly extending retainer and guide ears 125*c* are formed on each of the head ends of the keys for engagement with the retainer and guide windows 132 on each side of the sleeve 122. As best understood from FIG. 5, the ears 125*c* fit into a guide window in one of the legs 131 and a corresponding guide window in the other opposite leg 131 to maintain a coupled relationship between the head ends of the keys and the outer sleeve while permitting the keys to move longitudinally and to expand and contract radially between locking and release positions. Each of the keys has a pair of vertical, downwardly opening retainer slots 125*d* formed along each side of the lower end portion of the body section 125*b* of each key, sized and spaced to receive the pair of upwardly extending retainer fingers 145 on the side of the sleeve 124 holding the lower ends of the keys in operative relationship with the inner sleeve while permitting the necessary contraction and expansion of the keys. Each of the keys has an outer surface profile of bosses and recesses matching the operating boss and recess profile within the sliding sleeve valve and landing nipple so that the keys readily engage with and disengage from the sleeve valve 59 in opening and closing the sliding sleeve valve. In accordance with the invention, each key has a downwardly facing abrupt operating shoulder 125*e* for engaging and opening the sleeve valve and an abrupt upwardly facing shoulder 125*f* used to engage and close the sleeve valve. The keys are biased outwardly by springs 150 positioned within the keys around the inner body mandrel 123. Each spring has a three-sided rectangular body portion 150*a* which rests on the cylindrical outer surface of the portion of the body mandrel within the key. Each key also has outer arms 150*b* with hook-shaped ends engageable in two holes 125*g* through the central portion of each of the keys to keep the springs aligned within the keys along the body mandrel. The body mandrel 123 is reduced in diameter or undercut along a central portion 123*a* which lies behind substantially the full length of the keys 125 when the shifter is assembled and provides the necessary space for the springs 150 and to allow the keys to move inwardly or contract fully for release of the shifter from the sleeve valve and when the shifter is moving through the tubing string. A pair of flat surfaces 123*b* are provided for engagement of a holding tool during assembly of the shifter. The threaded upper end portion 123*c* of the body mandrel engages in the internal threaded lower end portion of the top sub 120. As shown in FIG. 2B, the top sub has an internal annular flange 120***a* to position the upper end of the body mandrel 123 in the top sub. As also evident in FIG. 2B, the top sub 120 threads into the outer sleeve 122 to the external annular stop flange 120*b* on the top sub while the upper end of the mandrel 123 threads into the top sub to the internal flange 120*a*. The mandrel 123 extends the entire length of the inner sleeve 124 and through the outer sleeve 122 into the top sub. The lower end portion 123*d* of the mandrel 123 is externally threaded for connection into a bottom sub 160 provided with a reduced threaded lower end portion 160*a* which, as shown in FIG. 2B, forms the head end of the safety valve 35. The mandrel 123 has an upwardly facing stop shoulder 123*e* at the upper end of the threaded section 123*b* which limits downward movement of the inner sleeve 124 during release of the shifter from a stuck sleeve valve.

When the sleeve shifter is fully assembled as in FIG. 2B with the inner and outer sleeves connected together by the shear screws 140, the operating keys 125 float within the side pockets defined, as previously discussed, along the opposite sides of the sleeves 122 and 124 and including the two slots 130 in the sleeve 122 with the springs 150 biasing the keys outwardly to sleeve valve engaging positions. So long as the sleeves 122 and 124 are interconnected by the shear screws, the keys may not move longitudinally though they are free for the expansion and contraction between sleeve engaging and release positions. Longitudinal movement of the keys is possible only when the screws 140 are sheared releasing the inner sleeve 124 for downward movement with the keys to lower longitudinal positions at which the head ends of the keys are cammed inwardly by the narrow lower window ends 134 in which the key ears 125*c* ride. Further discussion of the sleeve shifter operation will be found in connection with the procedure of installing and removing the safety valve tool train.

Figure 2C:
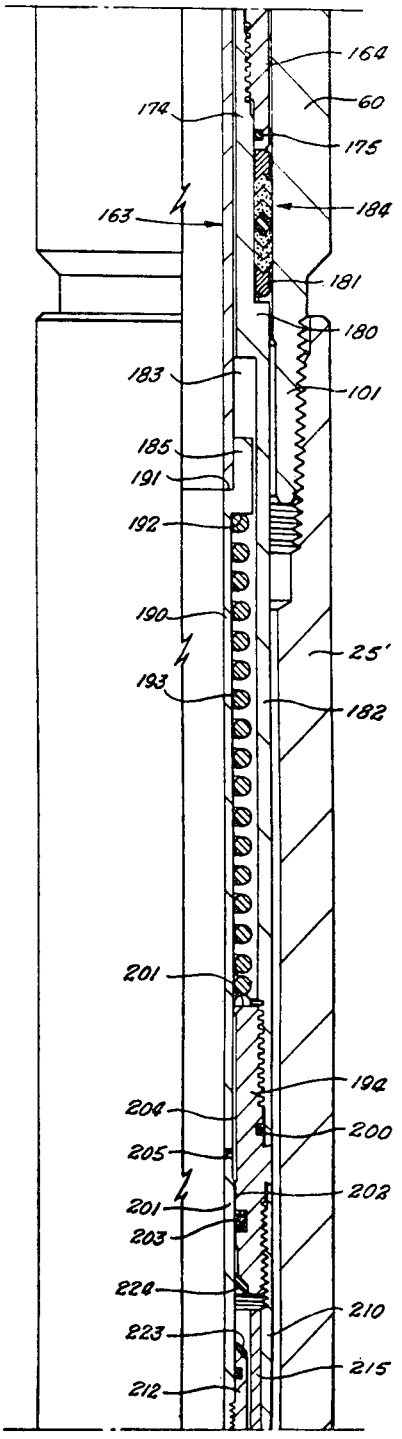
Figure 2D:
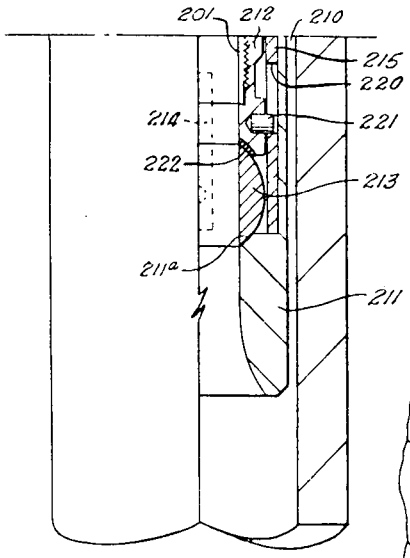

The safety valve 35 is shown in detail in the lower portion of FIG. 2B and FIGS. 2C and 2D. Referring to FIG. 2B, the bottom sub 160 of the sleeve shifter 34 forms the head end of the safety valve securing the safety valve to the sleeve shifter. The bottom sub has an internal seal assembly 160 in an internal annular recess formed within the lower end portion of the sub for sealing with a reduced upper end portion 162 of a valve operator tube section 163 of the safety valve 35. The bottom sub is threaded into the upper end of a housing head end 164 disposed in concentric spaced relation around the valve operator tube defining an annular control fluid chamber 165 between the operator tube and the housing head at the upper end of the safety valve. A side port 170 in the housing head end communicates control fluid to the annular chamber 165 for applying a fluid pressure to an annular piston 171 formed around the operator tube 163 for moving the valve operator tube downwardly to open the sliding sleeve valve responsive to control fluid pressure. The valve housing head end 164 has an internal flange 173 defining a bottom stop at the lower end of the control fluid chamber 165 below the piston 171. An external annular seal 172 in an external annular recess of the piston 171 seals around the piston with the inner wall surface of the valve housing head 164. The valve head housing 164 threads onto a housing section 174 which is enlarged at 180 providing an upwardly facing external annular stop shoulder 181 which serves a seal support function. An enlarged housing section 182 extends downwardly from the portion 180 in concentric spaced relation from the valve operator tube 163 defining a spring and fluid chamber 183 between the operator tube and the housing section. An external annular seal 184 is supported on the housing section above the shoulder 181 below the lower end edge of the valve head section 164 to seal around the valve housing section with the inner wall surface of the sleeve valve connector portion 60. The lower end of the valve control tube section 163 fits into a valve control tube head 185 on a lower valve operator tube section 190. An internal stop shoulder 191 within the head 185 provides a seat for the lower end edge of the operator tube section 163. A downwardly facing external annular stop shoulder 192 is provided on the head 185 for the upper end of a spring 193 within the chamber 183 for biasing the safety valve closed. The valve operator tube section 190 is slidable through a housing connector 194 which threads into the lower end of the housing section 182. The upper end edge of the connector section 194 provides an upwardly facing stop shoulder 201 which supports the lower end of the spring 193. A ring seal 200 in an external annular recess of the connector 194 seals between the connector and the lower end of the outer housing section 182.

The upper end edge 201 of the connector section 194 provides a stop shoulder for the lower end of the spring 193. The operator tube section 190 is slightly enlarged at 201 while the bore through the housing connector 194 is slightly reduced at 202 providing a close sliding fit between the operator tube section and the housing section. An internal ring seal assembly 203 within the housing connector section seals between the housing section and the operator tube section. Above the portion 201 of the operator tube section 190 and the portion 202 of the housing connector 194, the operator tube and housing connector are spaced slightly apart defining a small annular space 204 which communicates at an upper end with the spring chamber 183. A side port 205 is provided in the operator tube section 190 above the enlarged portion 201 to communicate the bore through the safety valve with the space between the operator tube section and the safety valve housing section 182 along the spring 193 and extending upwardly between the operator tube sections and the housing sections to the piston 171 on the head end of the operator tube section 163 below the seal 172, thereby applying well pressure to the piston which cooperates with the force of the spring 193 to close the safety valve.

The housing connector section 194 is threaded into a lower housing section 210 which supports and is formed integral with a bottom ball valve housing section 211 having an upwardly and inwardly facing ball valve seat 212. The operator tube portion 201 is threaded into a valve member 212 which supports a ball valve 213. The ball valve hangs from the valve member 212 on a pair of oppositely disposed hanger members 214. A guide sleeve 215 is disposed within the housing portion 210 and provided with a pair of longitudinal slots 220. A pair of guide pins 221 are engaged in opposite sides of the seat member 212 and extend radially outwardly into the guide slots 220 to hold the ball valve assembly against rotation in the housing as it is moved longitudinally for opening and closing the ball 213. A downwardly and inwardly facing arcuate seat 222 is formed in the lower end of the valve member 212 to seal with the ball valve 213. At the upper end of the valve member 212, FIG. 2C, another valve seat 223 is formed for engagement with a valve set 224 within the lower end of the housing connector 194 so that when the ball valve 213 is lifted and rotated to the closed position, not shown, the valve member 212 which supports the ball valve seals off with the connector section 194 to prevent fluid flow upwardly around the ball valve assembly into the valve housing. The ball valve structure shown at the lower end of FIG. 2D and in FIG. 2D is standard commerically available apparatus of the type shown as an Otis Remote-Controlled Ball-Type Subsurface Safety Valve shown at page 3,501 of *The Composite Catalog of Oilfield Equipment and Services,* supra. Similar types of ball valve structures which may also be used are shown in a patent to G. C. Grimmer, et al, U.S. Pat. No. 3,292,706 issued Dec. 20, 1966, and assigned to Otis Engineering Corporation.

Figure 3:
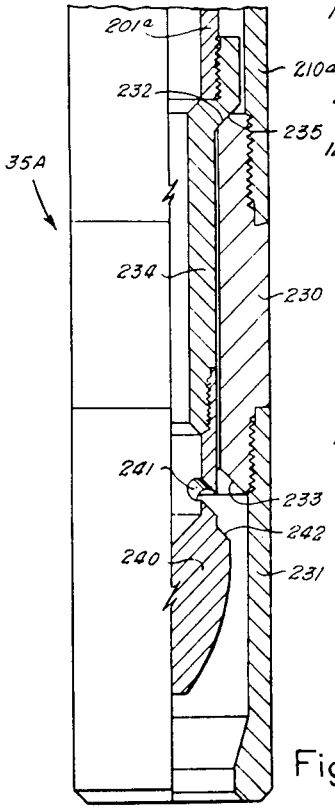
FIG. 3 is a fragmentary view in section and elevation of a poppet type safety valve usable in the tool string.
Figure 4:
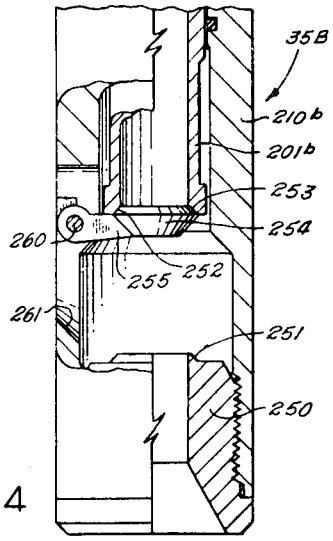
FIG. 4 is a fragmentary view in section and elevation of a flapper type safety valve usable in the tool string.

Alternate forms of valve types which may be used in lieu of the ball valve of FIG. 2D are shown in FIGS. 3 and 4 which illustrate poppet and flapper type valves, respectively. Referring to FIG. 3, a poppet type safety valve 35A is illustrated for use in the safety valve tool string. The actuating apparatus of the poppet valve is identical to that shown in FIGS. 2B and 2C so that the valve is held open by control fluid pressure from the surface and is closable when that control fluid pressure is reduced in response to the force of the spring 193 and tubing pressure applied to the piston 171. The poppet type safety valve 35A includes a lower housing section **210*a* threaded onto a valve seat member 230 which is connected to a lower end member 231. The valve seat member 230 has an upwardly and inwardly facing stop shoulder 232 and a downwardly and inwardly facing valve seat 233. A lower operator tube section 201*a* is threaded into a coupling 234 which has a downwardly and inwardly sloping stop shoulder 235 to limit the downward movement of the poppet valve when the valve is open as shown in FIG. 3. The coupling 234 is threaded into a poppet valve 240 having ports 241 and an external, upwardly and inwardly sloping seat 242. In the open position shown in FIG. 3, well fluids flow upwardly through the ports 241 in the poppet valve 240. The valve operator tube section 201*a* lifts the coupling 234 and the poppet valve 240 until the seat 242 engages the housing seat 233** at which position well fluids may not flow upwardly through the safety valve.

In the flapper type valve 35B shown in FIG. 4, a lower valve housing portion **210*b* is secured with a bottom nose portion 250 which has an upwardly extending top seat surface 251. The lower end of the valve operator tube 201*b* is provided with an internal downwardly facing annular valve seat surface 252 which is engageable with a seat surface 253 on a flapper valve 254. The flapper valve has an arm 255 hinged on a pin 260 within the upper end of a side pocket 261 formed along the side of the lower end portion of the bottom housing section 210*b*. When the valve 35B is closed as shown in FIG. 4, the flapper valve 254 engages the lower seat surface 252 on the lower end of the valve operator tube 201*b*. The valve 35B is opened by moving the operator tube 201*b* downwardly pivoting the flapper valve 254 clockwise on the pin 260 into the side pocket 261. The downward movement of the operator tube 201*b* is stopped by engagement of the tube seat 252 on the seat 251 of the bottom nose member 250 of the valve housing. The operating structure of the safety valve 35B which functions to open and close the valve is identical to that illustrated in FIG. 2C.**

The safety valve tool train 32, as shown assembled in FIG. 1, may include a safety valve of the ball, poppet, or flapper type, as desired. A well is completed for the use of the tool train by fitting the well with a tubing string including the landing nipple 30, the sliding sleeve valve 31, a packer 24 sealing around the tubing string within the casing of a producing formation, and a control fluid line 26 extending from a suitable control system at the surface through the well annulus to the sliding sleeve valve.

The safety valve tool string is run into the well tubing on a flexible wireline supported from a suitable string of wireline tools, including jars and a running tool which is releasably engageable with the locking mandrel 33. Such wireline equipment is illustrated and described at pages 3,478–3,484 of *The Composite Catalog of Oilfield Equipment and Services,* supra, showing an Otis wireline tool string together with running and pulling tools useful in installing and retrieving the safety valve tool string of the invention. Prior to the running of the safety valve tool string, the sliding sleeve valve 35 is closed with the valve member 59 of the sleeve valve being at an upper end position within the sleeve valve housing. When closed, the boss 98 of the sleeve valve 59 is engaged in the upper locking recess 55 in the nipple 30, FIG. 2B, and the upper end of the sleeve valve engages the shoulder 50. At this position of the valve member, the side port 61 in the sleeve valve is above the packing 66 and thereby isolated from the housing side port 65 so that control fluid cannot be communicated from the line 26 into the bore of the sleeve valve. The sleeve shifter 31 is in normal running condition, as shown in FIGS. 1 and 2B, at which the sleeve 124 is shear pinned with the sleeve 122 holding the keys 125 at the upper operating position at which the keys freely expand and contract as they drag along and pass various recesses, shoulders, and the like in the tubing string until the keys reach a landing and locking recess profile which matches the profile of the keys. In this mode, the keys are not free to move longitudinally and are used for properly locating the well tools and opening and closing the sliding sleeve valve.

The safety valve tube string 32 is lowered by means of the wireline until the safety valve 35 and the sleeve shifter 31 have passed through the landing nipple 30. As the sleeve shifter passes downwardly into the sliding sleeve valve, the keys 125 expand upon reaching the operating recesses within the upper end portion of the sleeve valve 59. The lower end portions of the keys expand sufficiently as they enter and move along the operating recesses of the valve member that the downwardly facing operating shoulder **125*e* on each of the keys enters the recess 88 of the valve member engaging the upwardly facing operating shoulder 90 of the sleeve valve. Since the shoulders 125*e* and 90 of the keys and valve member, respectively, are 90° shoulders, the keys are not cammed back inwardly but rather lodge against the sleeve valve so that a downward force is transmitted by the sleeve shifter keys to the sleeve valve. When the downward force is sufficient to overcome friction and the holding force of the collet finger bosses 98 in the locking recess 55 of the sleeve valve, the bosses are cammed inwardly from the locking recess releasing the sleeve valve for downward movement. The safety valve tool string continues moving downwardly with the sleeve shifter keys fully engaging the sleeve valve and forcing the sleeve valve downwardly to the lower open position shown in FIG. 2B. The relationship of the profiles of the recesses within the sleeve valve and on the keys of the sleeve shifter prevent the keys of the shifter from being cammed inwardly so that the keys remain coupled with the sleeve valve member preventing the shifter moving upwardly or downwardly relative to the sleeve valve. Also, the locking bosses 98 on the collet fingers of the sleeve valve expand into the lower locking recess 56 of the sleeve valve housing releasably locking the sleeve valve open. When the sleeve valve reaches the lower open position of FIG. 2B with the sleeve shifter coupled with the valve member as described, the locking keys 104 of the locking mandrel 33 are aligned with and expand into the locking recesses 42 and 43 of the landing nipple 30. The expander mandrel 102** of the locking mandrel is activated to wedge the keys outwardly to lock the locking mandrel with the landing nipple. Generally, the running tool used will include a prong, not shown, extending downwardly from the tool to hold the safety valve open so that well fluids may flow through the valve as it is lowered in the well bore to the landing nipple. The prong is retrieved with the running tool releasing the safety valve for remote control operation.

With the safety valve tool train locked with and supported from the landing nipple through sliding sleeve valve, the safety valve is opened for well flow by applying control fluid pressure from a suitable controllable source at the surface through the line 26 leading to the sleeve valve. The control fluid flows into the sleeve valve housing through the side port 65, around the sleeve valve 59 between the upper seal 70 and the lower seal 76 which span the side port. The control fluid flows through the side port 61 in the sleeve valve into the annulus space within the sleeve valve member around the safety valve tool train. The control fluid fills the annular space around the train within the landing nipple 30 and sleeve valve housing extending from the seal 111 at the upper end, FIG. 2A, downwardly to the seal 184 at the lower end. The control fluid flows laterally inwardly through the side port 170 at the head end of the safety valve into the annular chamber 165 above the operator piston 171 of the safety valve. The pressure of the control fluid acts downwardly on the piston against the upward force of the spring 193 and the well pressure within the tubing string as applied through the side port 205 upwardly on the piston. When the control fluid pressure applies sufficient downward force to the piston to overcome the spring and well pressure forces, the safety valve is opened, as shown in FIG. 2D, by the downward movement of the safety valve operator tube on which the piston 171 is formed. So long as the control fluid pressure is maintained sufficiently high, the safety valve remains open. When closure of the safety valve is desired, the control fluid pressure is reduced so that the force of well pressure through the side port 205 and the spring 193 lift the operator tube of the safety valve closing the valve.

The safety valve tool string 32 is removed from the tubing string by a wireline tool string and an appropriate pulling tool which engages the locking mandrel 33. Application of an upward force to the fishing neck of the locking mandrel releases the locking keys on the mandrel so that the tool string may be pulled upwardly from the landing nipple 30. The upward force is applied to the sleeve shifter 34 which transmits the upward force through the keys 125 to the shoulder 89 of the sleeve valve. The inner sleeve 122 and outer sleeve 124 of the sleeve shifter are secured together by the shear pins 140 so that the upward force applied to the sleeve shifter is transmitted from the inner and outer sleeves to the keys 125 through the lower ends of the keys which rest on the ring 143 of the sleeve 124 at the upwardly extending fingers 145. The resistance of the sleeve valve 59 applies an opposing downward reaction force to the sleeve shifter keys through the downwardly facing internal shoulder 89 of the sleeve valve which engages the upwardly facing shoulders **125*f* on the keys 125. Thus, the upward force applied to the sleeve shifter is actually transmitted through the shoulder 125*f* on the keys to the sleeve valve. This upward force cams the locking bosses 98 on the collet fingers of the sleeve valve inwardly releasing the sleeve valve from the lower locking recess 56 within the sliding sleeve valve housing, FIG. 2B. The sleeve valve is then lifted by the sleeve shifter keys. In accordance with the invention, when the release shoulder surface 125*h* on each of the keys reaches the inwardly sloping internal cam surface 47 within the sleeve valve housing, the sleeve shifter keys are cammed inwardly at the upper ends of the keys disengaging the key shoulder 125*f* from the internal operating shoulder 89 at the upper end of the sleeve valve 59. The sleeve valve and sleeve shifter key surfaces are dimensioned and proportioned such that by the time the keys 125 are cammed inwardly sufficiently along the upper end portions of the keys to release the keys from the sleeve valve, the sleeve valve is moved to the upper closed position at which the side port 61 of the valve member is above the seal assembly 66.** The keys of the sleeve shifter are releasable only when the sleeve has returned upwardly to the closed position so that the keys are cammed inwardly. With the tool string fully released from the landing nipple and sleeve valve, the tool string is pulled back to the surface leaving the sleeve valve closed.

Figure 7:
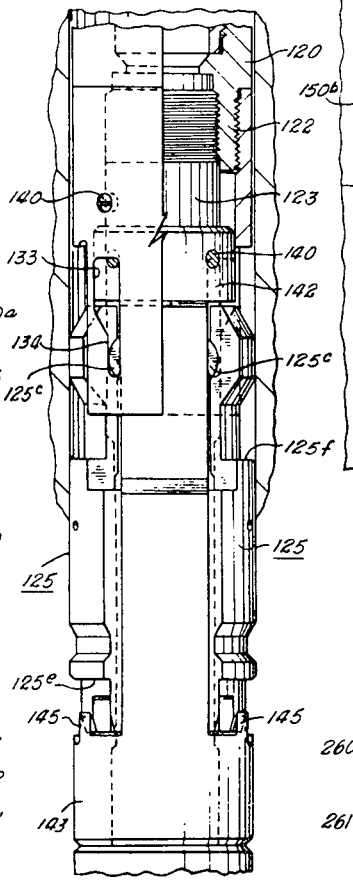
FIG. 7 is a fragmentary view in section and elevation of the sleeve shifter showing the keys in the release mode for freeing the shifter from a jammed or stuck sleeve valve or from a fixed landing nipple as represented by FIG. 17B.
Figure 6:
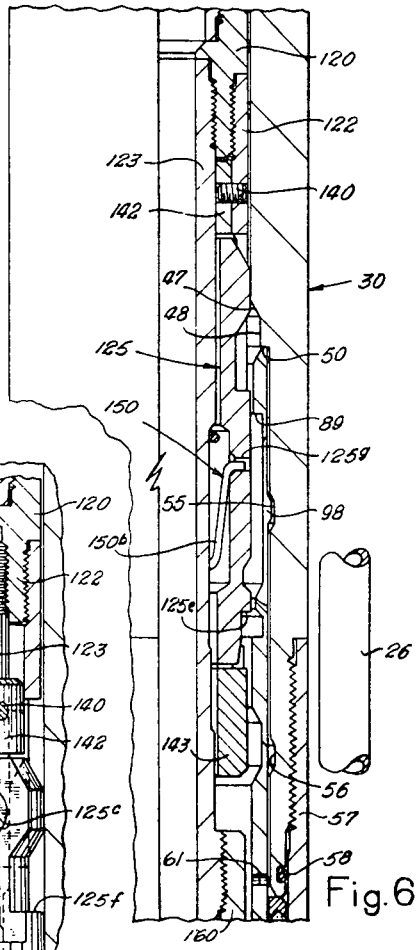
FIG. 6 is a fragmentary view in section and elevation showing principally the sleeve shifter with the sleeve operating keys in the normal running mode during installation and removal.

In the event, in removing the safety valve tool string from the landing nipple and sliding sleeve valve, it is found that the sleeve valve 59 is jammed open and cannot be released and closed with normal force without damaging the sleeve shifter, the sleeve shifter has means for an emergency release from the sleeve valve. The upward force which can be safely applied to the sleeve shifter without damaging it is a force which is below the shear strength of the screws 140 which couple the outer sleeve 122 with the inner sleeve 124. It will be recalled that when an upward force is applied to the sleeve shifter which is transmitted to the sliding sleeve valve through the keys 125, the keys may be said to be carried upwardly by the lower ring portion 143 of the sleeve 124 as the upward force is applied from the head 120 of the sleeve shifter to the outer sleeve 122, and through the shear screws 140 to the inner sleeve head 142, with the inner sleeve supporting the keys insofar as upward force is concerned. Thus, with the keys and the inner sleeve being urged downwardly by the reaction of a stuck sleeve valve, the resistance of the sleeve valve applies a high shear force to the screws 140. When this force exceeds the capability of the screws to hold, they are sheared, as represented in FIG. 7. The downward resistance of the sliding sleeve valve on the keys 125 holds the keys and thus the sleeve 124 against upward movement. With the keys and the sleeve 124 being held and the shear screws severed, the sleeve shifter head 120, the sleeve 122, and the mandrel 123 are lifted relative to the keys and the sleeve 124. As the sleeve 122 moves upwardly, the ears **125*c* on the upper ends of each of the keys 125 are guided into the narrow lower guide window portions 134 of the sleeve 122 camming the upper ends of the keys inwardly so that the shoulder 125***f* on each of the keys is disengaged from the shoulder 89 within the upper end portion of the sleeve valve 59. The other upwardly facing surfaces on the sleeve shifter keys slope upwardly and inwardly and the lower end portions of the keys are held out only by the outward force of the springs 150 so that with the keys released from the abrupt shoulder contact, the upward force on the sleeve shifter cams the keys fully inwardly to the positions shown in FIG. 7 so that the sleeve shifter is released from the sleeve valve member allowing the safety valve tool train to be pulled by the wireline to the surface leaving the sleeve valve, however, open. The sleeve valve then must be closed in a separate operation by use of special conventional wireline tools designed to perform the emergency procedure of closing the sleeve valve.

The sleeve shifter 31 may be returned to normal operating condition at the surface by removal of the shear pin fragments, returning the keys and inner sleeve back upwardly to the positions of FIGS. 1 and 2B, and reinsertion of new shear pins 140 to reconnect the inner and outer sleeves 122 and 124 together.

The landing and locking system of the invention for selectively locating and securing well tools at landing sections along a flow conductor has been described in terms of a set of locating and locking keys 125 on the sleeve shifter 34 and a locating and locking recess profile within the sliding sleeve valve 31. The use of oppositely facing stop shoulders on both the key profiles and within the profile of the sliding sleeve valve in planes perpendicular to the longitudinal axis of the sleeve shifter and sleeve valve precludes both downward and upward movement of the sleeve shifter in the sliding sleeve valve once it is properly so located. The upwardly facing shoulder of the sleeve member prevents the downward movement of the sleeve shifter through the sleeve valve so that the sleeve valve is moved from an upper closed to a lower open position. The presence of the downwardly facing shoulder within the sleeve valve member and the corresponding upwardly facing shoulder on the profile of the shifter keys precludes upward movement of the sleeve shifter through the open sleeve valve so that the sleeve valve moves upwardly to close with the sleeve shifter until the appropriate cam surface is reached for release of the keys from the sleeve valve member. Thus, the use of the key profile and the sliding sleeve valve profile illustrated in FIGS. 1, 2A–2D, 6, and 7 provides means for locating the sleeve shifter at an appropriate sliding sleeve valve, opening the sliding sleeve valve, and closing the sliding sleeve valve. The sleeve shifter keys ar normally releasable from the sliding sleeve valve only after the sleeve valve has been returned to the upper closed position.

The features of the invention are readily adaptable to providing a selective system wherein a desired number of sleeve valves may be secured along the length of a single flow conductor and well tools may be positioned, as desired, each at a preselected one of the sleeve valves which may be opened and closed by providing a sleeve shifter having operating keys designed to function with the particular sliding sleeve valve. FIGS. 8–17 show a family of operating key profiles each of which has a locating and locking profile which is different from all of the other keys within the series. The ten different operating key profiles illustrated provide the possibility of the landing and locking of well tools in a flow conductor at ten different landing section locations along the length of a flow conductor. At each of such locations it is, of course, necessary that the flow conductor landing section include a locating and locking profile which is compatible with the operating keys on the well tool desired to be located at such position along the flow conductor. The locating and locking profile may be provided along the flow conductor in either a landing section comprising a sliding sleeve valve assembly of the type illustrated in FIGS. 2A–2D and FIG. 17A, or the profile may be formed along a landing section which does not include a sliding sleeve valve, such as is represented in FIG. 17B.

In the sleeve valve form of landing section, the profile is in two portions, one in the sleeve member and one in the body member. In the form shown in FIGS. 17B the internal profile is a continuous integral profile in the landing section body only. The locating and locking profiles shown in FIGS. 17A and 17B are compatible with the key profile illustrated in FIG. 17 and, thus, any well tool carrying the locating and locking key of FIG. 17 would engage and lock at either of the profiles shown in FIGS. 17A or 17B. For purposes of brevity, locating and locking profiles for a flow conductor which are compatible with the keys illustrated in FIGS. 8–16 are not shown though it is to be understood that the structure of landing sections of a flow conductor at such profiles would be the same as suggested by FIGS. 17A and 17B except that the exact shape of the profiles would conform in each instance to the corresponding key profiles shown in FIGS. 8–16. As stated otherwise, a flow conductor adapted to receive and lock ten different well tools having the key profiles of FIGS. 8–17 would include landing section flow conductor structure of the nature of FIGS. 17A or 17B or a combination of both at ten different spaced locations along the length of the flow conductor so that each well tool would be locatable and lockable at only a single one of the flow conductor locations. Any one such well tool would pass through the nine other flow conductor locations without the keys expanding into and locking at the non-compatible landing section profiles.

Figures 8, 9, 10, 11, 12, 13, 14, 15, 16, 17, 17A, 17B:
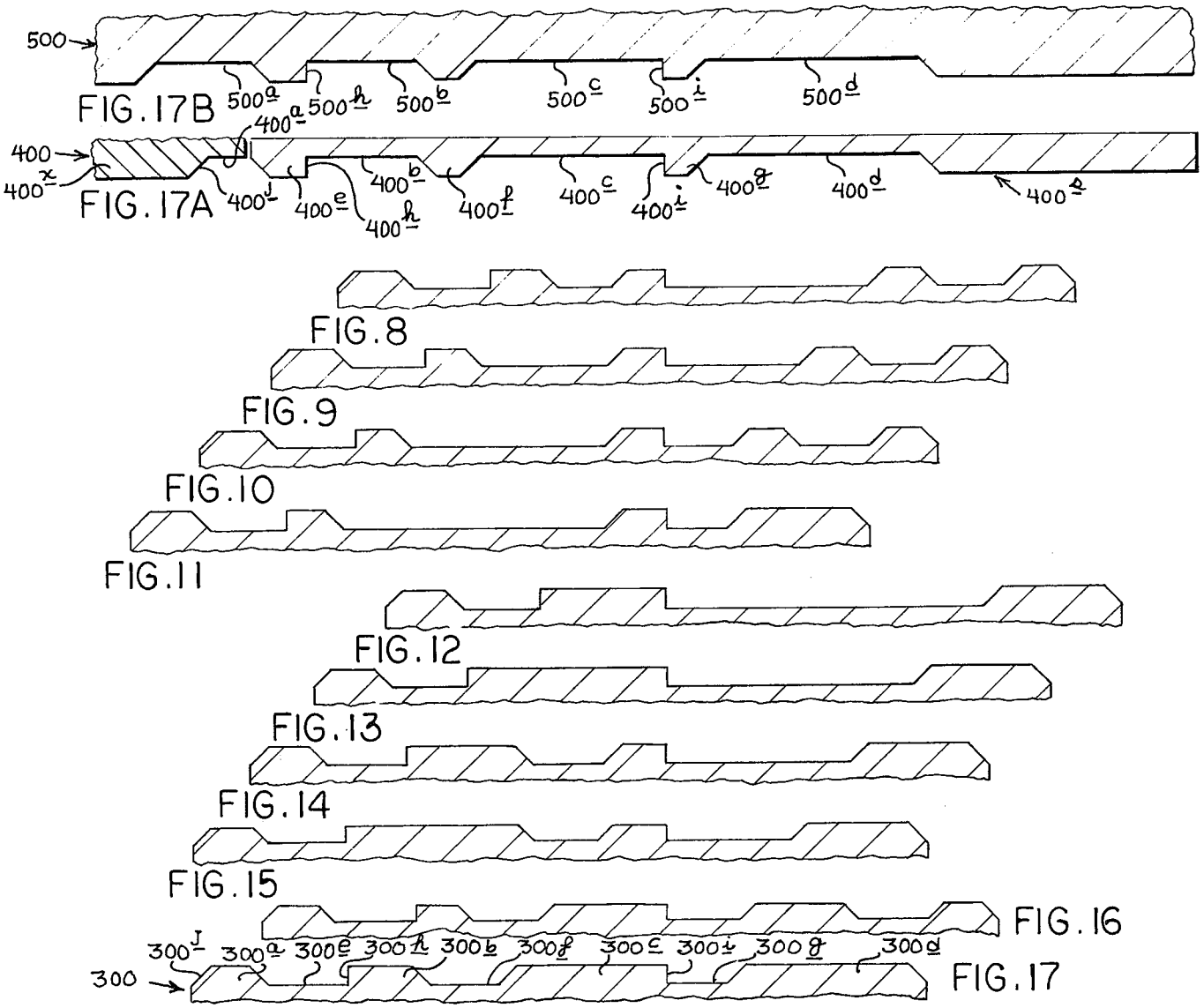
FIGS. 8–17 illustrate a variety of selective landing and locking key profiles having the features of the invention.
FIG. 17A illustrates a sliding sleeve valve profile operable with a key as shown in FIG. 17.
FIG. 17B illustrates a landing nipple having a selective landing and locking profile which will receive the key of FIG. 17.

Referring to FIG. 17, a locating and operating key 300 is illustrated which may be considered as equivalent of the operating keys 125 which have been previously described and shown in relation to the sleeve shifting tool 34. The operating keys 300 differ from the keys 125 only in terms of the shape of the locating and locking profile along the outer surfaces of the keys. The operating key 300 is compatible with and operable in the locating and operating recesses of a sliding sleeve valve 400 as represented in FIG. 17A. The key 300 has apaced external operating bosses 300*a,* 300*b,* 300*c,* and 300*d* which are received in correspondingly located and shaped recesses 400*a,* 400*b,* 400*c,* and 400*d* provided along the locating and locking profile of the sliding sleeve 400, which is shown in FIG. 17A in a closed relationship at which the sleeve portion 400S is at a closed position relative to the fixed body portion 400X of the sleeve assembly. The key 300 also has spaced internal recesses 300*e,* 300*f,* 300*g,* which receive and correspond with internal operating bosses 400*e,* 400*f,* and 400*g* along the profile of the sliding sleeve valve 400. In accordance with the invention, the key 300 has two longitudinally spaced lock shoulders 300*h* and 300*i* which are engageable, respectively, with two longitudinally spaced lock shoulders 400*h* and 400*i* along the profile of the sliding sleeve 400. Additionally, the key 300 has a cam surface 300*j* provided along a first end of the boss 300*a* which is engageable with a corresponding cam surface 400*j* at a first end of the recess 400*a* of the body portion of the profile of the sliding sleeve 400 for the purpose of release of the key 300 from the sleeve 400.

The operating keys 300 are carried by a suitable well tool such as the sleeve shifter 31 which moves along a flow conductor either by pumpdown or wireline methods which involve transporting the well along the flow conductor to the desired sliding sleeve. Since movement of the well tool in the flow conductor is involved, and a certain time lag is required for the operating keys on the well tool to expand into the locating and locking profile of the sliding sleeve, it is essential that the bosses 300*a*, 300*b*, 300*c*, and 300*d* on the key 300 be shorter than the corresponding sleeve recesses 400*a*, 400*b*, 400*c*, and 400*d*. It will be understood that if the key bosses were shorter than the sleeve recesses only by enough to allow the keys to expand with a fairly close fit into the sleeve profile, the key would most likely fail to seat in the sleeve profile and, thus, the well tool would pass through the sleeve without locking. With enough tolerance between the length of the key bosses and the sleeve profile recesses, the keys will fully expand at the usual normal installation speed at which the well tool supporting the keys 300 is manipulated. The locking and operating shoulders 300*h* and 300*i* on the key 300 are sufficiently closer together measured along the length of the key 300 than the corresponding sleeve profile operating shoulders 400*h* and 400*i* to allow enough longitudinal movement of the key 300 within the profile of the sleeve 400 for the key to be cammed inwardly to a release position when the sleeve portion 400S is returned to the first end position illustrated in the FIG. 17A. As the key 300 moves along the sleeve 400 toward the body portion 400X of the sleeve, the cam surface 300*j* on the key 300 must engage the cam surface 400*j* in the sleeve sufficiently in advance of the arrival of the sleeve portion 400S at the end position to cam the end portion of the key 300 inwardly enough that at the end position of the sleeve the key locking shoulder 300*h* is at a non-interferring relationship or position inwardy of the sleeve locking shoulder 400*h* to release the keys 300 from the sleeve 400 so that the tapered surfaces along the key bosses in the direction of key movement will cause the key to move fully inwardly releasing from the sleeve so that the well tool carrying the keys 300 is freed from the sleeve assembly. Thus, the distance between the cam surface 300*j* and the operating stop shoulder 300*h* on the key 300 must be substantially greater than the distance between the cam surface 400*j* and the operating stop shoulder 400*h* of the sleeve assembly 400 when the sleeve portion 400S of the sleeve assembly is at the end position adjacent to the fixed body portion 400X for key release. It will be recognized in terms of the description of the operating of the sleeve shifter 34 in the sleeve valve 31 that the end cam surface on the operating keys 125 engages the cam surface within the sleeve valve for releasing the keys well in advance of the arrival of the sliding member of the sleeve at the end position corresponding to FIG. 17A.

Thus, the key 300 moves along a flow conductor into a landing section comprising the sleeve assembly 400 toward the movable sleeve member of the assembly 400. The key expands into the internal profile of the sleeve assembly with the key shoulder 300*i* engaging the sleeve shoulder 400*i*. The sleeve member 400S is moved from a first end position as shown to a second opposite end position in the same manner as previously described in connection with the opening of the sleeve valve 31. In returning the well tool carrying the key 300 in the opposite direction toward the fixed body portion 400X of the sleeve assembly, the key initially is not releasable from the sleeve member 400S due to the engagement of the key shoulder 300*h* with the sleeve shoulder 400*h*. The sleeve member 400S is moved in the body 400X by the key toward the cam surface 400*j*. When the cam end surface 300*j* on the key engages the sleeve assembly cam surface 400*j* as the sleeve portion 400S is moving, the key begins the movement inwardly out of the sleeve assembly locating and locking profile. The use of the dual shoulder on the keys and in the sleeve assembly profile permits sleeve operation with the keys and precludes key release until the sleeve has returned to the first end position.

In a well system a flow conductor may be provided with as many sleeve assemblies of the type illustrated in FIG. 17A as desired providing each of the assemblies has a different locating and locking profile from all of the other assemblies. As previously stated, FIGS. 8–17 illustrate ten different operating key profiles which are operable with ten different sleeve assembly locating and locking profiles so that ten such sleeve assemblies may be spaced along a single flow conductor and any one or all of ten different well tools with compatible operating keys may be landed and locked at desired locations along the flow conductor.

The principal features and advantages of the present invention are not only applicable to selective landing and locking of well tools at sleeve assemblies along a flow conductor, but also may be used in modified form to serve the function of such other well tools as removable collar stops and collar locks. Collar stops and collar locks serve well known functions in well systems such as to prevent well tools accidently dropped into a well from passing out the bottom of the tubing in the case of a collar stop, and to locate various types of sub-surface well equipment along a well bore in the case of the collar lock. Typical collar stops and collar locks of a type manufactured and sold by Otis Engineering Corporation are illustrated and described at page 3,974 of *The Composite Catalog of Oil Field Equipment and Services*, 1974–75 Edition, published by World Oil, Houston, Tex. Collar stops and collar locks are normally designed for location at a coupling recess along a flow conductor at the connections between the sections of pipe forming the conductor. In some installations where a form of pipe is used which does not provide the coupling recess, a landing section of pipe may be included provided with an internal locating and locking profile as shown in FIG. 17B which is similar to the profile illustrated in FIG. 17A. The primary difference in the structure represented in FIG. 17B is the absence of a movable sleeve member. The locating and locking profile shown in FIG. 17B may be provided within a pipe section such as the flow conductor landing sections illustrated in U.S. Pat. No. 2,862,564, supra, comprising pipe sections as shown in FIGS. 1, 2 and 3 which are connected with the remainder of the pipe forming the flow conductor. As shown in FIG. 17B, a locating and locking profile in the landing section 500 has spaced recesses 500*a*, 500*b*, 500*c*, and 500*d* which receive, respectively, the operating bosses 300*a*, 300*b*, 300*c*, and 300*d* on the key 300. The recess 500*a* is modified in length as compared with the recess 400*a* of the sleeve valve assembly 400 when the sleeve member 400S is at the end position illustrated in FIG. 17A. This lengthening of the recess 500*a* is necessary to permit the key shoulder 300*h* to engage the landing section shoulder 500*h* without contact of the key cam surface 300*j* with the recess surface 500*j*. This variation from the design of the sleeve assembly 400 is required for the keys to remain locked in the locating and locking recess profile of the landing section 500. While the profile pattern of the sleeve assembly 400 provides the cam surface 400*j* for caming the keys inwardly to release or disengage the keys from the sleeve assembly, no such corresponding function is provided with the landing section 500. The keys 300 are removable from the landing section 500 only by application of an external force such as is supplied when the sleeve shifter 34 is disabled by applying sufficient force to the sleeve shifter to release the sleeve 122 for retracting the keys 125 by movement of the sleeve shifter head relative to the keys as previously discussed in connection with the operation of the sleeve shifter 34. In using the alternate form of the invention wherein a landing section 500 is employed, a well tool such as the sleeve shifter 34 functions as an anchor tool to lock within the landing section 500 to serve a collar stop or collar lock function. The co-engagement of the stop shoulders on the operating keys of the sleeve shifter with the stop shoulders 500*h* and 500*i* in the landing section prevents movement of the sleeve shifter in either direction in the flow conductor. The sleeve shifter is then removed by applying a force which exceeds the shear pin capacity of the sleeve shifter so that it is disabled in the sense that the shear pins give way to allow retraction of the locating and locking keys by the operating mechanism of the sleeve shifter as distinguished from the cam action of the operating surfaces along the internal profile of the landing section 500.

As with the sleeve assembly of FIG. 17A, the landing section of FIG. 17B may be varied by changing the design of the locating and locking profile therein so that selectivity may be provided to locate and lock well tools along a flow conductor at any desired one of several such landing sections included in the flow conductor by providing each well tool with the keys having profiles compatible with the desired landing section. The provision of the spaced locking shoulders facing in opposite directions together with the other profile features serves both selectivity and opposite direction stop functions.

While the locating and locking keys have been disclosed as supported and operated on a specific sleeve shifting tool, it is to be understood that such keys may be included on any suitable well tool capable of moving the keys along a flow conductor and expanding and contracting the keys either responsive to or independent of the landing section profiles.

For purposes of brevity, the profiles of the keys represented in FIGS. 8–16 have not been numbered and described in detail, it will be understood that each such key is equivalent to the keys 125 and 300 and operate as such keys in compatible landing section profiles.

What is claimed is:

1. Locating and locking apparatus for selectively positioning and securing a well tool at a desired location along a flow conductor of a well bore comprising: means providing a landing section in said flow conductor having an internal locating and locking profile including a first internal stop shoulder facing a first longitudinal direction along said landing section and a second internal stop shoulder spaced from said first stop shoulder and facing in a second opposite longitudinal direction along said landing section; said first and second stop shoulders lying in planes substantially perpendicular to the longitudinal axis of said landing section along said flow conductor; and means providing an anchoring tool including at least one locating and locking key having an external locating and locking profile engageable in said internal profile of said landing section, including longitudinally spaced and longitudinally oppositely facing first and second external stop shoulders lying in planes substantially perpendicular to the longitudinal axis of said anchoring tool and co-engageable with said first and second stop shoulders in said landing section profile to arrest movement of said anchoring tool in either direction along said flow conductor.

2. Apparatus in accordance with claim 1 wherein said landing section profile comprises a combination of alternate recesses and bosses and said locking key has alternate external recesses and bosses, said bosses on said locking key being receivable in said recesses along said landing section profile.

3. Apparatus in accordance with claim 2 wherein said bosses along said locking key are sufficiently shorter than said recesses along said landing section profile that said key expands into said landing section profile at a normal operating speed of said anchoring tool through said landing section.

4. Apparatus in accordance with claim 3 wherein said internal landing section profile is a continuous integral feature along said landing section whereby said landing section profile locks said key against movement in either of said opposite longitudinal directions along said landing section and said key is releasable only responsive to a force applied to said key to effect inward movement of said key out of said landing section profile independently of said landing section profile.

5. Apparatus in accordance with claim 3 wherein said landing section includes an internal longitudinally sliding sleeve, said oppositely facing stop shoulders within said landing section profile are provided within said sliding sleeve, said landing section profile has a sloping cam surface along a first end portion thereof independent of said slidable sleeve for camming said key inwardly out of said landing section profile to release said key from one of said stop shoulders along said profile, and said key has a sloping cam surface along a corresponding first end thereof co-engageable with said cam surface of said landing section profile for forcing said key inwardly out of said landing section profile responsive to movement of said sliding sleeve by said key toward said cam surface of said landing section profile; when said sliding sleeve is at an end position adjacent to said cam surface of said landing section profile, said cam surface of said landing section profile in closer to the nearest of said stop shoulders of said sliding sleeve than the distance between said cam surface on said first end of said key and the nearest stop shoulder of said key whereby the coaction between said cam surface on said key and said cam surface of said landing section profile forces said key inwardly disengaging said key from said sliding sleeve.

6. Apparatus in accordance with claim 5 including a plurality of said landing sections spaced along said conductor, each of said landing sections having a different profile configuration from the remaining landing sections whereby only a single compatible key profile configuration is engageable with each of said landing section profile configurations for selectively locating anchoring tools along a flow conductor.

7. Apparatus in accordance with claim 6 including a plurality of anchoring tools, each of said anchoring tools having one of said keys provided with an external profile configuration different from the keys on the remainder of said anchoring tools and said key profile configuration being engageable with a single one of said profile configurations of said landing sections.

8. A landing section for a flow conductor of a well for landing and locking an anchoring tool along said flow conductor comprising means providing an internal integral continuous profile surface configuration having two internal stop shoulders spaced longitudinally along said landing section and facing in opposite longitudinal directions for restraining an anchoring tool against movement in opposite longitudinal directions along said landing section; said stop shoulders lying in planes substantially perpendicular to the longitudinal axis of said flow conductor.

9. A plurality of landing sections in accordance with claim 8 each of which is provided with a profile configuration different from the profile configurations of all other of said landing sections to permit selective landing and locking of one or more anchoring tools along a flow conductor.

10. Locating and locking apparatus for positioning and securing a well tool along a flow conductor of a well bore comprising: means providing a landing section connectible in said flow conductor, said landing section having an internal longitudinally slidable sleeve member, an internal locating and locking profile within said landing section having two longitudinally spaced stop shoulders facing in opposite longitudinal directions and each being in a plane substantially perpendicular to the longitudinal axis of said landing section, said stop shoulders being located along said sleeve member of said landing section, said sleeve member being movable between a first end position and a second opposite end position, a portion of said internal profile of said landing section being within a body member of said landing section independent of said sleeve member and having an internal cam surface sloping inwardly in a direction away from said sleeve member, a first of said stop shoulders in said sleeve member nearest said landing section cam surface facing in the same direction as said cam surface; and an anchoring tool having a locating and operating key provided with an external profile configuration having external longitudinally spaced stop shoulders facing in opposite directions and lying in planes substantially perpendicular to the longitudinal axis of said key, said stop shoulders on said key being co-engageable with said stop shoulders within said sleeve member of said landing section, said key having a cam surface along a first end portion adjacent to a first of said stop shoulders on said key, said first of said stop shoulders along said first end of said key facing in a direction opposite to said first stop shoulder of said landing section profile nearest said cam surface of said landing section profile for engagement with said first stop shoulder of said landing section profile to move said sleeve member toward said cam surface of said landing section profile, said cam surface on said key being co-engageable with said cam surface of said landing section for releasing said key from said landing section profile on movement of said sleeve member toward said cam surface of said landing section profile, said first stop shoulder in said sleeve member of said landing section and said cam surface of said landing section body member being closer together when said sleeve member is at said first position than said first stop shoulder of said key and said cam surface on said key.

11. Apparatus in accordance with claim 10 wherein said stop shoulders on said key are closer together than said stop shoulders in said sleeve member by a value sufficient for said cam surface on said key to move in advance of said first stop shoulder in said sleeve member when said keys move said sleeve member toward said cam surface of said landing section to cam said key inwardly for release of said key from said landing section when said sleeve member is returned to said first end position.

* * * * *

UNITED STATES PATENT OFFICE

CERTIFICATE OF CORRECTION

Patent No. 4,043,392 Dated August 23, 1977

Inventor(s) Imre I. Gazda

It is certified that error appears in the above-identified patent and that said Letters Patent are hereby corrected as shown below:

The Figure on the cover sheet should read as per attachment.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*

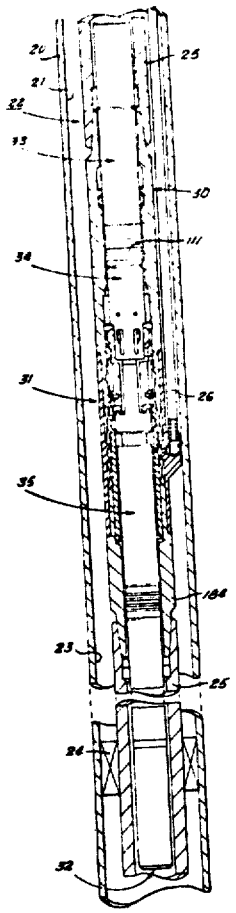
20
21
22
33
25
50
111
34
31
26
35
184
23
25
24
32